United States Patent [19]

Miller et al.

[11] 4,294,373

[45] Oct. 13, 1981

[54] LIGHTWEIGHT METAL CONTAINER

[75] Inventors: Edward C. Miller, Broomfield; David A. Straw, Lakewood, both of Colo.

[73] Assignee: Ball Corporation, Muncie, Ind.

[21] Appl. No.: 159,733

[22] Filed: Jun. 16, 1980

Related U.S. Application Data

[63] Continuation of Ser. No. 962,493, Nov. 20, 1978, abandoned, which is a continuation-in-part of Ser. No. 900,411, Apr. 26, 1978, abandoned.

[51] Int. Cl.[3] ..... B23K 9/00

[52] U.S. Cl. ..... 220/70; 220/66

[58] Field of Search ..... 220/70, 66, 67

[56] References Cited

U.S. PATENT DOCUMENTS

| | | | |
|---|---|---|---|
| 3,693,828 | 9/1972 | Kneusel et al. | 220/70 |
| 3,730,383 | 5/1973 | Dunn et al. | 220/70 |
| 3,942,673 | 3/1976 | Lyu et al. | 220/70 |
| 3,979,009 | 9/1976 | Walker | 220/70 |
| 3,998,174 | 12/1976 | Saunders | 220/70 |
| 4,048,934 | 9/1977 | Wallace | 220/70 |

FOREIGN PATENT DOCUMENTS

| | | | |
|---|---|---|---|
| 425592 | 6/1911 | France | 220/70 |
| 321509 | 6/1957 | Switzerland | 220/66 |

*Primary Examiner*—Joseph Man-Fu Moy
*Attorney, Agent, or Firm*—Gilbert E. Alberding

[57] ABSTRACT

A lightweight metallic container is disclosed and claimed having a side wall and an effective rigid bottom wall integral therewith. The side wall and bottom wall merge to define a first inclined face, the inclined face forming an angle of between about 35° and 45° with respect to the axis of said container, a tapered member is provided and is integrally formed at the juncture of the side wall and inclined face, the member having a taper angle in a given range and a given wall taper thickness, an annular surface integrally connected to the first inclined wall for supporting the container, a second inclined face integrally connected to the annular surface, and a curved panel integrally connected with the second inclined face. The curved panel is so formed that it has a radius of curvature greater than the diameter of the annular surface. The height of the second inclined face is less than half the height of the first inclined face. The metallic container as so defined has an improved bottom configuration that provides for substantial column strength as well as internal pressure stability. One important feature of the subject bottom configuration is the reduced amount of metal used to manufacture the container.

10 Claims, 3 Drawing Figures

LIGHTWEIGHT METAL CONTAINER

BACKGROUND OF THE INVENTION

This application is a continuation of our earlier copending application Ser. No. 962,493 filed Nov. 20, 1978, now abandoned, which, in turn, is a continuation-in-part of our copending patent application Ser. No. 900,411 filed Apr. 26, 1978, now abandoned.

The present invention relates to metal container bodies and more particularly to metal container bodies of the seamless variety comprised of a side wall and a bottom formed integrally therewith. The container bottom of the subject invention has a improved configuration to provide for adequate column strength along the vertical axis of the container as well as stability against internal pressure generated by the contents of the container after it has been closed and sealed.

DESCRIPTION OF THE PRIOR ART

There have been numerous container configurations produced by manufacturers and this has been especially true for the two-piece container manufacturer, that is, a container having a body that has an integral bottom wall at an end and the opposite end is configured to have a closure secured thereto. Container manufacturers package beverages of various types in these containers formed of either steel or aluminum alloys. The most ideal type of container bottom wall would be a flat wall which would allow for maximum capacity for a given container with a minimum height. However, such a container is not economically feasible because in order to prevent deformation the thickness of the bottom wall would have to be of such magnitude that the cost of the container would be prohibitive. In order to negate these costs drawing and ironing processes have been installed and extensively used in recent years, especially for the aluminum container industry. In the production of these containers that utilize drawing and ironing it is important that the body wall and bottom wall of the container be as thin as possible so that the container can be sold at a competitive price. Much work has been done on thinning the body wall.

Aside from seeking thin body wall structures various bottom wall configurations have been investigated. In this regard strength of the container was a paramount factor in these investigations. An early attempt in seeking sufficient rigidity of the bottom wall is to form the same into a spherical, dome configuration. This general configuration is shown in U.S. Pat. No. 3,760,751. The bottom wall is thereby provided with an outwardly concave dome or depression which extends substantially throughout the bottom wall of the container. In effect, this domed configuration provides increased strength and resists deformation of the bottom wall under increased internal pressure of the container with little change in the overall geometry of the bottom wall throughout the pressure range for which the container is designed.

Various modifications of the dome configuration have been manufactured. In this regard, the dome structure itself was integrally formed with other curvilineal or walled members, usually at different inclinations to that of the longitudinal axis of the container in order to further strengthen the container structure. Although such modifications rendered improved rigidity and stability it has been found that such characteristics can still be achieved and in some aspects even improved upon with a minimum of metal being required. Although this domed configuration allows container manufacturers to somewhat reduce the metal thickness, these manufacturers are continuously working on techniques that will allow for further reduction in metal thickness without sacrificing container rigidity. An optimized configuration has not been an easy task.

A number of containers are known and described in the patent literature having a circular side wall and an integral bottom wall comprising an inwardly domed panel having a nose or connecting portion around the periphery thereof that merges with the side wall. The connecting portion itself generally comprises an annular supporting member or bead having connected thereto an arcuate section or sections. Containers provided with this general type of bottom structure are illustrated in a number of prior art patents. For example, U.S. Pat. No. 3,355,060 to Reynolds, et al., discloses a container having an integral bottom with a domed center panel recessed inwardly, and U.S. Pat. No. 3,423,985 to Stolle, et al., shows a can structure having an integral bottom portion provided with a bead member with inclined surfaces and a recessed domed panel. In U.S. Pat. No. 3,963,828 to Kneusel, et al., a can bottom is defined having inclined surfaces extending from the side wall and a recessed domed center panel. Further, in U.S. Pat. No. 3,730,383 to Dunn, et al., there is a disclosure of a container having outer and inner inclined surfaces with a recessed domed center panel. Still further, U.S. Pat. No. 3,942,673 to Lyu, et al., discloses a container having a bottom wall including an ellipsoidal dome surrounded by a substantial vertical wall portion which merges with the side wall of the container along an outwardly directed bead. Finally, Austrian Pat. No. 272,187 discloses a container having a domed center portion that is recessed inwardly.

As is known, a large quantity of containers are manufactured annually and the producers thereof are always seeking to reduce the amount of metal utilized in making containers while still maintaining the same operating characteristics. Simply, a change in equipment could be very costly. Because of the large quantities of containers manufactured a small reduction in metal thickness, even on the order of one thousandth of an inch, would definitely reduce manufacturing costs substantially. Of course, reduction in metal thickness cannot be exercised indiscriminately since failure of packaged materials would often result and especially with the packaging of pressurized materials such as beer, ale or other carbonated beverages which exert a high pressure in the container.

SUMMARY OF THE INVENTION

According to the present invention, a cylindrical container having a cylindrical side wall and a bottom wall is formed using conventional equipment but so formed that certain structural features are incorporated that reduce a small but significant amount of metal utilized for such containers so as to render them highly competitive with containers of apparently the same general form.

The instant invention is directly concerned with providing a metal container configuration made with slightly less metal than containers of almost similar structural appearance. Although the amount of metal saved per container is small, it certainly is significant since many thousands of containers are produced and therefore any savings would be substantial. In brief, the subject invention relates to an improved bottom structure that can be manufactured with less metal and yet be consistent with strength and volume requirements for containers of almost the same general appearance.

The particular metal container of the subject invention is profiled in such a way that column strength, pressure stability and other characteristics are not jeopardized yet the amount of metal utilized in producing the container structure is slightly yet significantly reduced. In particular, the container is specifically configured to be capable of withstanding substantial internal pressure without deforming in the order of 95 psi and loads of the order of 350 pounds and still retaining its serviceability. Moreover, the instant invention is concerned with providing a seamless metal can structure that is particularly advantageous as regards minimal metal thickness for a domed configured can bottom consistent with other strength and stability requirements. The improved configuration of the container bottom of the instant invention is such that where the container is a drawn and ironed container it can be readily formed in the tool pack of a conventional or standard draw and iron can bodymaker and at the end of the ironing operation so that no separate and costly operation need be used.

It is known that a beverage carrying a charge of carbon dioxide when packaged in a relatively thin drawn and ironed metal container has a tendency to evert or buckle outwardly when exposed to the forces that develop within such a container under certain conditions, and especially during pasteurization or storage at warm temperatures. As noticed by the afore-mentioned collection of prior art patents, container manufacturers have been striving endlessly to produce a competitively priced container that has sufficient resistance to eversion or buckling when exposed to high pressures that often develop within the container. Atlhough the varied configurations of the prior art have admittedly answered well, they have fallen short of the optimum. The subject invention provides a savings in metal over related structures because of the thinner gauges employed and a balance of structural components comprising the metal container of the profiles herein described and defined.

Accordingly, an object of this invention is to provide a can or container body whose particularly profiled bottom wall has improved pressure resistance as compared to a conventional can structure.

Another object of this invention is to provide a profiled bottom wall for drawn and ironed containers which permits the bottom wall thereof to be made of very thin metal stock and yet maintain eversion resistance commensurate to containers formed from relatively thicker metal stocks.

Another object of this invention is to provide a metal container having a configuration that its load bearing properties thereof are in a substantially balanced condition.

Still another object of this invention is to provide a container body having a structural design without over construction of any feature thereof with optimum utilization of the metal employed therein.

Another object of this invention is to provide the art with a domed bottom container structure having an equalized or substantially equalized load bearing configuration.

Other objects and advantages of this invention will be apparent to those skilled in the art from an inspection of the drawings, description and claims herein.

DETAILED DESCRIPTION

In accordance with several important aspects of this invention, the bottom portion of the metal container is provided with a specially configured feature to be described in more detail herein. In general, the metal container has a side wall and an effective rigid bottom wall integral therewith, said side wall and bottom wall merging to define a first inclined face, said inclined face forming an angle of between about 35° and 45° with respect to the axis of said container, the thickness of said first inclined face being greater than the thickness of said side wall, a tapered member integrally formed at the juncture of said side wall and inclined face, said member having a taper angle in the range of about 1.3° to 2.2° and a wall taper thickness of between about 0.006 inch and about 0.010 inch, an annular surface integrally connected to said first inclined wall for supporting the container, a second inclined face integrally conected to the annular surface, the height of said second inclined face being less than half the height of said first inclined face, and a curved panel integrally connected with said second inclined face. The lightweight metal container comprises a unitary structure having a seamless cylindrical side wall and a bottom wall integrally formed with the side wall at the lower portion thereof, said bottom wall comprising a tapering surface extending downwardly from said side wall, said tapering surface forming a taper angle in the range of about 1.3° to about 2.2° and a wall taper thickness of between about 0.006 inch and about 0.010 inch in excess of said side wall, an outer frustoconical surface extending downwardly and inwardly from said tapering surface toward the axis of said container, said outer frustoconical surface forming a bottom angle of about 35° to about 45° with respect to the longitudinal axis of the container, a bottom radius integrally connected with and extending downwardly from said outer frustoconical surface providing an annular supporting surface for the container, an inner frustoconical surface integrally connected with said bottom radius and extending upwardly and inwardly from said annular supporting surface toward the axis of said container, the height of said inner frustoconical surface being less than half the height of said outer frustoconical surface, and a downwardly concave center panel integrally connected with said inner frustoconical surface and extending upwardly and inwardly from said inner frustoconical surface to the axis of said container, said center panel extending slightly aove the height of the outer frustoconical surface.

Figure 1:
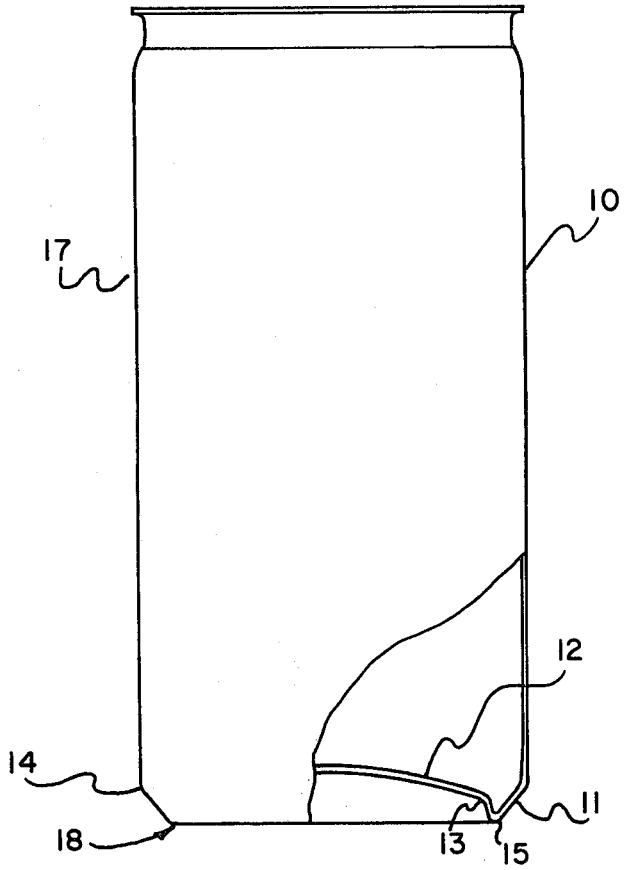
FIG. 1 is an elevated view in partial section showing a container body with an end profile in accordance with the subject invention.

With reference to the drawings, FIG. 1 depicts a seamless metal container 17 provided with a side wall 10 and an outer substantially frustoconical surface 11 extending downwardly and inwardly from the side wall 10 to the axis of said container, an annular bead 15 extending from the first frustoconical surface providing an annular supporting surface for the container, an inner substantially frustoconical surface 13 extending upwardly and inwardly from the annular head 15 toward the axis of the container, and a recessed domed center panel 12 extending upwardly and inwardly from the inner frustoconical surface to the axis of the container. It should be stated that container body 17 may be readily produced in a draw and iron press, the container bottom 18 being integrally connected to the side wall 10 and can be easily shaped on a standard and appropriate bottom doming device.

Figure 3:
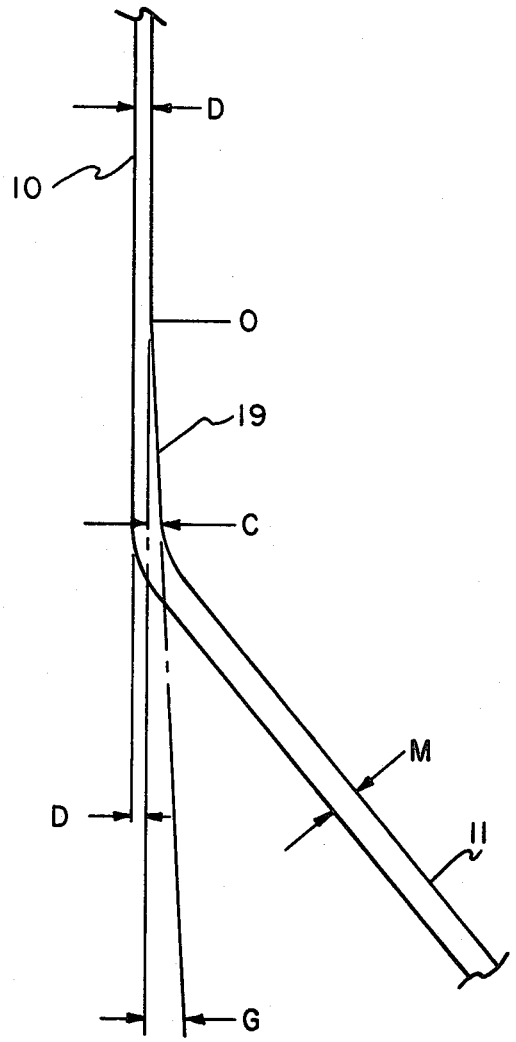
FIG. 3 is a greatly enlarged fragmentary illustration of bottom body area of a container showing the novel tapered configuration of the subject invention.

Referring now to FIG. 3 there is shown a greatly enlarged view of a tapered cofiguration of the subject invention where the side wall 10 and outer frustoconical surface 11 unite. In particular, this configuration is integrally connected with the side wall and comprises a taper angle G formed from a point O one side of which is parallel to the inner side wall and the other being tangent to an inner sloping side 19. It has been found that the taper angle G should be between about 1.3° and about 1.7° for steel containers and between about 1.8° and about 2.2° for aluminum containers. The taper thickness and taper angle affects such container qualities as denting as well as column strength and the subject invention has substantially optimized these characteristics for the containers herein described.

Figure 2:
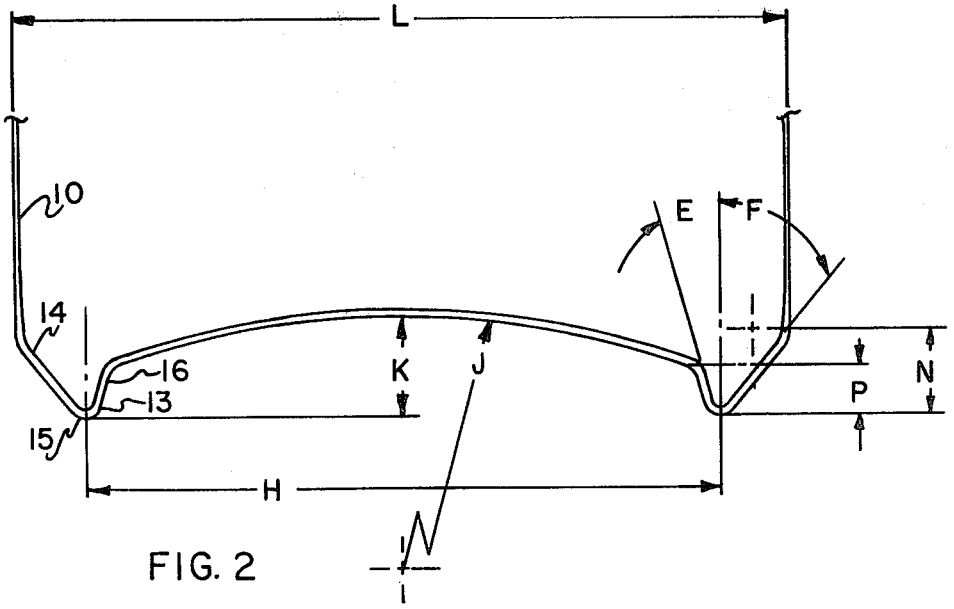
FIG. 2 is a fragmentary cross-sectional illustration of the bottom portion of a container of the subject invention.

As shown in further detail in FIG. 2, the container bottom 18 is provided with a recessed domed center panel 12 that is so configured that it approximates the segment of a sphere having a radius of curvature J and recessed to a particular height K. It is preferred that the height of the inner frustoconical surface P be substantially less than the height of outer frustoconical surface. In accordance with this invention it is preferred that the height of the inner frustoconical surface P be less than half the height of the outer frustoconical surface. The inner frustoconical surface 13 and the axis of the container form an angle E which has been found to lie in the range of about 8° to about 20°. In particular, the preferred range for aluminum containers is about 12°±4 while the preferred range for steel containers is about 16°±4. The outer frustoconical surface 11 and the axis of the container form a further angle F. It has been found that the angle F be limited to a range of about 35° to about 45° with 40° being preferred. It will be appreciated that as the angle F increases the concavity of the bottom radius 15 decreases and would result in a smaller diameter of support H. Of course, too small a radius of support H for a given container would render it less stable and more likely to tip over.

An important aspect of the instant invention is the wall taper thickness. This is depicted in FIG. 3 as C therein and is the added thickness in excess of the wall thickness D. In general, the side wall thickness for a 12 ounce aluminum container is about 0.0049±0.0004 inch, and for a 12 ounce steel container the side wall thickness is about 0.0038±0.0004 inch. Thus, the tapering of wall 19 adds a slight but additional thickness, referred to as wall taper thickness and has been found to be most advantageous when about 0.007 inch±0.001 inch for steel containers and about 0.009 inch±0.001 inch for aluminum containers.

The aforementioned wall taper thickness in conjunction with the wall taper angle when in ranges herein disclosed provide a very economical metal container having suitable column strength and internal pressure rigidity.

Of course, the wall taper thickness and side wall thickness are integral and are not separate one from the other. When total maximum thickness is reached (about 0.0110 inch for steel and 0.0135 inch for aluminum containers) the outer frustoconical surface is reached, this surface having a thickness of about the starting container stock thickness.

Illustrative dimensions for aluminum and steel containers of FIGS. 1 and 2 are as follows where the thickness of the center panel is 0.0135 inch for aluminum and 0.0110 inch for steel.

| | For Cans Having A Body Diameter L of About 2.60" | |
|---|---|---|
| | Aluminum | Steel |
| Metal Thickness, M | 0.0135" | 0.0120" |
| Wall Thickness, D | 0.0049" | 0.0038" |
| Nose Diameter, H | 2.150" | 2.150" |
| Dome Depth, K | 0.3650" | 0.3300" |
| Height of Outer Surface, N | 0.274" | 0.273" |
| Height of Inner Surface, P | 0.103" | 0.105" |
| Center Panel Radius, J | 2.3500" | 2.9000" |
| Bottom Angle, F | 40° | 40° |
| Dome Wall Angle, E | 12° | 16° |
| Wall Taper Angle, G | 2° | 1.5° |
| Wall Taper Thickness, C | 0.0090" | 0.0070" |
| Can Weight, Lbs. 1000 | 29.0 | 68.0 |
| Stability Angle, Filled | 24° | 24° |
| Column Strength, Lbs. | 450 | 600 |
| Eversion Resistance, psig | 100 | 105 |
| Ratio of Radius of Curvature (J) to Nose Diameter (H) $\frac{2J}{H}$ | 2.186 | 2.698 |
| Ratio of Metal Thickness to Wall Thickness $\frac{M}{D}$ | 3.0 | 3.2 |

| | For Cans Having A Body Diameter L of About 2.47" | |
|---|---|---|
| | Aluminum | Steel |
| Metal Thickness, M | 0.0135" | 0.0110" |
| Wall Thickness, D | 0.0049" | 0.0038" |
| Nose Diameter, H | 2.100" | 2.100" |
| Dome Depth, K | 0.3500" | 0.3200" |
| Height of Outer Surface, N | 0.228" | 0.226" |
| Height of Inner Surface, P | 0.102" | 0.103" |
| Center Panel Radius, J | 2.3500" | 2.9000" |
| Bottom Angle, F | 40° | 40° |
| Dome Wall Angle, E | 12° | 16° |
| Wall Taper Angle, G | 2° | 1.5° |
| Wall Taper Thickness, C | 0.0090" | 0.0070" |
| Can Weight, Lbs./1000 | 28.8 | 66.2 |
| Stability Angle, Filled | 22° | 22° |
| Column Strength, Lbs. | 480 | 550 |
| Eversion Resistance, psig | 105 | 100 |
| Ratio of Radius of Curvature (J) to Nose Diameter (H) $\frac{2J}{H}$ | 2.38 | 2.762 |
| Ratio of Metal Thickness to Wall Thickness $\frac{M}{D}$ | 3.0 | 3.2 |

Stability of a metal container is an important factor to the maker and to the consumer. Unstable cans interfere with the operation of the filling and packing machinery. Such machinery operates at high speed and cans which rock or wobble excessively cannot be handled by the machinery. From the viewpoint of the consumer, a can which tips or wobbles is not satisfactory. Stability of a can body was measured by placing a can on a flat and level surface and gradually tipping from vertical until an angle is reached at which the can becomes unstable and tips over and at about this instant the angle from the can center line to vertical is recorded and is called the stability angle.

As for the column strength determination, measurements were made by placing the can body vertically and pressing it downward on a base plate of standard testing machine and a force is applied at a constant rate to the upper end of the can body, evenly distributed around the upper edge, and at the instance the can body fails the force is observed and recorded.

As is known, cans employed for the packaging of pressurized products such as beer or carbonated beverages must be able to withstand internal pressures of about 95 psi. Beer is usually pasteurized in the filled and sealed can at a temperature and for a time which results in an internal pressure of 85 psi. Generally to allow for error of temperature or time, the minimum acceptable pressure capacity of 90 psi. On the other hand, carbonated beverages vary according to the degree of carbonation. The highest degree of carbonation is encountered with club soda water which may produce an internal pressure at 100° F. of about 95 psi. Since the same can body should be useful for all pressurized beverages 95 psi is taken as the minimum pressure capability. In order to determine eversion resistance the amount of pressure that a can body can withstand is measured. The can body is clamped by a side wall so that the side wall is sealed and the can bottom is unsupported and free. Hydraulic fluid is introduced into the can and the pressure indicated by a gauge. At the instant the can bottom reverses from concave outward to convex outward the pressure is observed and recorded.

It has been found that the instant invention provided a significant increase in resistance to eversion so that more rigid and stiffer containers can be produced by having the dimensions described herein.

It will be readily appreciated that when the radius of curvature J of the center panel 12 is made smaller there is more resistant to eversion of the center panel than a container having a larger radius of curvature. It has been determined, however, that it was advantageous not to make a metal container with too small a radius of curvature. At first it was thought that by going to a larger radius of curvature the center panel would thereby be made structurally weaker and unserviceable due to the likelihood of eversion. On the contrary, it was surprising to find that the container itself having the configuration herein described was made stronger. Not only was the average or mean eversion resistance increased thereby, but also the range of pressure at which failure occurred was markedly reduced around that mean. It was further observed that in those few cases where failure did occur it was not catastrophic because the failure did not affect the bottom annular surface which supports the container and therefore the container would still remain in its upright position.

From the above it is clear that an essential feature of the instant invention is the degree of curvature of the domed panel itself. As already stated, the greater the concavity of such a panel the greater its strength. In this regard, however, it was discovered that the concavity must not be too great and that the radius of curvature for the dome panel must be greater than the nose diameter, i.e., $J>H$. This relationship is important in that by having a predetermined range for the radius of curvature the forces that come to bear upon the dome surface to cause eversion are in balance or substantially equal to that acting upon the inner frustoconical surface to cause its eversion. The analogy of a chain being no stronger than its weakest link would be appropriate here. In the subject invention the forces required to cause eversion or buckling of the dome would be equal or substantially equal to those required to cause eversion of buckling of the inner frustoconical wall. In effect, there is an equalized strengthening of the load-bearing properties for the respective structural elements or surfaces of the subject invention. Simply, the two inner contiguous surfaces of the container bottom, viz., the dome and its connecting inner frustoconical surface, have in accordance with this invention been equalized or substantially equalized in their load bearing capacity. In addition to this strengthening feature of the container bottom, the relatively larger radius of curvature allows a somewhat flatter dome so that a container manufacturer is able to produce a slightly smaller body diameter or container height and still contain a volume equal to that of the prior art container (i.e., conventional 12 ounce can) which has a slightly higher dome by virtue of a smaller radius of curvature.

It has been found, moreover, that the fluid volume to metal weight ratio for the container made in accordance with this ivention is greater than similar prior art containers. Thus, the subject invention may use relatively thin metal stocks, i.e., thickness in the range of about 0.0135 or less for aluminum stock and about 0.0110 or less for steel stock. In general, it has been determined that the ratio of panel wall thickness to side wall thickness for aluminum containers should be 3.00 or less whereas for steel container this ratio should be 3.20 or less. When such thin stock materials are employed and are made to conform to the other structural features herein defined and claimed there is found a substantial savings in metal as compared to cans of similar configuration but not possessing these optimum characteristics.

Furthermore, as already alluded to, the stability of the container after eversion is enhanced by the subject invention in that the container disclosed herein remains stable. It will be appreciated that a container having a smaller radius of curvature or greater concavity for the dome would more than likely upon eversion result in an unstable container due to the outwardly everted portion of the bottom structure that would extend beyond the supporting member.

From the above it can be said that when the radius of curvature of the dome is larger than the nose diameter there are advantages of this relationship in that (1) there is substantial equalization of load bearing characteristics of the dome and the inner surface so that the forces or pressures that would tend to evert either the dome or the inner surface are about equal, (2) a slightly smaller body diameter or container height may be manufactured since a given container would have a slightly flatter dome and as a result the fluid volume to weight ratio for the container would be greater than that of the prior art, and lastly (3) there would be a tendency to a better stability of a container even after eversion. It will be appreciated upon further consideration of these advantages that the first two would lessen the amount of metal required to construct a container.

A wide range of ferrous and aluminum-base alloys may be used for container stock to produce the containers in accordance with the subject invention. The preferred ferrous or steel stock are those of low-carbon killed steels of commercial drawing quality. They are of the continuous or ingot casted types wherein their killing media may be either aluminum or silicon. A preferred type of steel is the continuously-casted steel having various annealed tempers, such as the T-I annealed temper. Although a wide range of aluminum-base alloys may be employed for the container stock of the subject invention, a preferred aluminum-base alloy is 3004 H-19 aluminum-base stock of good drawing and ironing quality.

It will be appreciated that a container constructed in accordance with the teachings of the present invention will allow the manufacturer to reduce the metal utilized without sacrificing rigidity or substantially decreasing the resistance to eversion usually achieved by using a material having a thickness corresponding to what is presently used for these types of containers.

What is claimed is:

1. A lightweight aluminum-base alloy container capable of withstanding a substantial internal pressure without eversion comprising a unitary structure having a seamless cylindrical side wall and a bottom wall integrally formed with the side wall at the lower extremity thereof, the ratio of the thickness of said bottom wall to the thickness of said side wall being 3.0 or less, said bottom wall comprising a tapering surface extending downwardly from the side wall, said tapering surface forming a taper angle of between 1.3° and about 2.2° and a wall taper thickness of between about 0.006 inch and about 0.010 inch in excess of the side wall, an outer frustoconical surface extending downwardly and inwardly from said side wall toward the axis of said container, said outer frustoconical surface forming a bottom angle of between about 35° and about 45° with respect to the axis of the container, a bottom radius integrally connected with and extending downwardly from said outer frustoconical surface providing an annular supporting surface of the container, said annular supporting surface having a diameter in the range of about 2.05 inches to about 2.2 inches, an inner frustoconical surface integrally connected with said bottom radius and extending upwardly and inwardly from said annular supporting surface toward the axis of the container, said inner frustoconical surface forming an angle in the range of about 12°±4° with respect to the axis of the container, the height of said inner frustoconical surface being less than half the height of said outer frustoconical surface, and a downwardly concaved center panel integrally connected with said inner frustoconical surface and extending upwardly and inwardly from said inner frustoconical surface to the axis of said container, the radius of curvature of said downwardly concaved center panel being between about 2.250 inches and about 3.000 inches, said center panel extending at its uppermost portion slightly above said height of said outer frustoconical surface.

2. The container as recited in claim 1 wherein the cylindrical side wall is about 0.0045 inch to about 0.0055 inch in thickness.

3. The container as recited in claim 1 wherein the dome height is between about 0.290 inch and 0.375 inch.

4. A lightweight aluminum-base alloy container capable of withstanding a substantial internal pressure without eversion comprising a unitary structure having a seamless cylindrical side wall and a bottom wall integrally formed with the side wall at the lower extremity thereof, the ratio of the thickness of said bottom wall to the thickness of said side wall being about 3.0 or less, said bottom comprising a tapering surface extending downwardly from the side wall, said surface forming a taper angle of about 2° and a wall taper thickness of about 0.009 inch in excess of said side wall, an outer frustoconical surface extending downwardly and inwardly from said side wall toward the axis of said container, said outer frustoconical surface forming a bottom angle of about 40° with respect to the axis of the container, a bottom radius integrally connected with and extending downwardly from said outer frustoconical surface providing an annular supporting surface for the container, an inner frustoconical surface integrally connected with said bottom radius and extending upwardly and inwardly from said annular supporting surface toward the axis of the container, said inner frustoconical surface forming an angle of about 12° with respect to the axis of the container, the height of said inner frustoconical surface being less than half the height of said outer frustoconical surface, and a downwardly concaved center panel integrally connected with said inner frustoconical surface and extending upwardly and inwardly from said inner frustoconical surface to the axis of said container, the radius of curvature of said downwardly concaved center panel being greater than the diameter of the annular supporting surface, the ratio of the radius of curvature to the nose radius of the annular supporting surface being between about 2.2 and about 2.7, said center panel extending at its uppermost portion slightly above said height of said frustoconical surface.

5. The container of claim 4 wherein said side wall of said container is about 0.0049±0.0004 inch and the center panel thickness is about 0.0135 inch.

6. The container of claim 4 wherein the nose diameter of the bottom thereof is about 2.150 inches.

7. The container of claim 4 wherein the nose diameter of the bottom thereof is about 2.150 inches and having a body diameter of about 2.600 inches.

8. The container of claim 4 wherein the nose diameter of the bottom thereof is about 2.100 inches.

9. The container of claim 4 wherein the radius of curvature of the downwardly concaved center panel is about 2.350 inches.

10. The container of claim 4 where the aluminum-base alloy is 3004 H-19.

* * * * *